US010684586B2

(12) United States Patent
Sato et al.

(10) Patent No.: US 10,684,586 B2
(45) **Date of Patent: *Jun. 16, 2020**

(54) IMAGE FORMING APPARATUS PROVIDED WITH LINK MEMBER CAPABLE OF MOVING DEVELOPING UNIT IN INTERLOCKING RELATION TO MOVEMENT OF COVER

(71) Applicant: Brother Kogyo Kabushiki Kaisha, Nagoya-shi, Aichi-ken (JP)

(72) Inventors: Shougo Sato, Seto (JP); Hideshi Nishiyama, Owariasahi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/220,202

(22) Filed: Dec. 14, 2018

(65) Prior Publication Data

US 2019/0121283 A1 Apr. 25, 2019

Related U.S. Application Data

(63) Continuation of application No. 15/679,248, filed on Aug. 17, 2017, now Pat. No. 10,197,965.

(30) Foreign Application Priority Data

Sep. 30, 2016 (JP) ..... 2016-194664

(51) Int. Cl.
*G03G 15/00* (2006.01)
*G03G 21/16* (2006.01)
*G03G 21/18* (2006.01)

(52) U.S. Cl.
CPC ..... *G03G 21/1633* (2013.01); *G03G 21/1666* (2013.01); *G03G 21/1814* (2013.01)

(58) Field of Classification Search
CPC ..... G03G 21/1633; G03G 21/1666; G03G 21/1814
See application file for complete search history.

(56) References Cited

U.S. PATENT DOCUMENTS 7,656,421 B2 2/2010 Itabashi
8,948,651 B2 2/2015 Lee
(Continued)

FOREIGN PATENT DOCUMENTS

JP 2000-181329 A 6/2000
JP 2001-166556 A 6/2001
(Continued)

OTHER PUBLICATIONS

May 23, 2018—(US) Non-Final Office Action—U.S. Appl. No. 15/679,248.
(Continued)

*Primary Examiner* — David M. Gray
*Assistant Examiner* — Michael A Harrison
(74) *Attorney, Agent, or Firm* — Banner & Witcoff, Ltd.

(57) ABSTRACT

An image forming apparatus includes: a housing, a cover a process cartridge, an LED array, and a link member. The cover is pivotally movable about an axis extending in a first direction between an open position and a closed position. The process cartridge includes a photosensitive drum and a developing unit, and is attachable to and detachable from the housing in an open state where the cover is at the open position. The link member is movable in a second direction perpendicular to the first direction in interlocking relation to movement of the cover. The link member is configured to: move the developing unit away from the axis in the second direction during movement of the cover from the closed position to the open position; and move the developing unit
(Continued)

toward the axis in the second direction during movement of the cover from the open position to the closed position.

19 Claims, 9 Drawing Sheets

(56) References Cited

U.S. PATENT DOCUMENTS

| | | | | |
|---|---|---|---|---|
| 8,948,656 | B2 | 2/2015 | Nakano | |
| 2001/0002953 | A1 | 6/2001 | Sato | |
| 2005/0047821 | A1 | 3/2005 | Murayama et al. | |
| 2006/0093398 | A1 | 5/2006 | Hayakawa | |
| 2009/0058978 | A1 | 3/2009 | Itabashi | |
| 2009/0175652 | A1 | 7/2009 | Kamimura | |
| 2010/0046979 | A1* | 2/2010 | Lee | G03G 21/1633 399/90 |
| 2012/0183323 | A1 | 7/2012 | Nakano et al. | |
| 2013/0121722 | A1 | 5/2013 | Nakano | |
| 2013/0308976 | A1 | 11/2013 | Sekido | |
| 2014/0105644 | A1 | 4/2014 | Kamimura et al. | |

FOREIGN PATENT DOCUMENTS

| | | | |
|---|---|---|---|
| JP | 2004-240354 | A | 8/2004 |
| JP | 2004-301899 | A | 10/2004 |
| JP | 2005-062274 | A | 3/2005 |
| JP | 2005-077441 | A | 3/2005 |
| JP | 2006-154746 | A | 6/2006 |
| JP | 2008-046402 | A | 2/2008 |
| JP | 2008-185780 | A | 8/2008 |
| JP | 2009-058729 | A | 3/2009 |
| JP | 2009-162912 | A | 7/2009 |
| JP | 2013-105039 | A | 5/2013 |
| JP | 2013-242439 | A | 12/2013 |

OTHER PUBLICATIONS

Oct. 10, 2018—(US) Notice of Allowance—U.S. Appl. No. 15/679,248.

* cited by examiner

IMAGE FORMING APPARATUS PROVIDED WITH LINK MEMBER CAPABLE OF MOVING DEVELOPING UNIT IN INTERLOCKING RELATION TO MOVEMENT OF COVER

CROSS REFERENCE TO RELATED APPLICATION

This application is a continuation of U.S. patent application Ser. No. 15/679,248 filed Aug. 17, 2017, which claims priority from Japanese Patent Application No. 2016-194664 filed Sep. 30, 2016. The entire content of the priority applications are incorporated herein by reference.

TECHNICAL FIELD

The present disclosure relates to an image forming apparatus.

BACKGROUND

Japanese Patent Application Publication No. 2001-166556 discloses an image forming apparatus including a housing, a photosensitive drum, an LED array, a developing unit, a belt, and a transfer roller. The LED array exposes the photosensitive drum to light, so that an electrostatic latent image is formed on a peripheral surface of the photosensitive drum. The developing unit supplies toner to the photosensitive drum, so that the electrostatic latent image is developed to form a toner image on the peripheral surface of the photosensitive drum. The belt is positioned below the photosensitive drum. The belt runs in a horizontal direction while contacting the photosensitive drum. The toner image is transferred onto the belt, and then further transferred from the belt to a sheet by the transfer roller.

The developing unit is attachable to and detachable from the housing of the image forming apparatus. The developing unit and the LED array are arrayed in a running direction of the belt in a state where the developing unit is attached to the housing of the image forming apparatus.

SUMMARY

In the conventional image forming apparatus as disclosed in the JP publication, smooth attachment and detachment of the developing unit to and from the housing is desired.

In view of the foregoing, it is an object of the present disclosure to provide an image forming apparatus in which the developing unit can be smoothly attached to and detached from the housing of the image forming apparatus.

In order to attain the above and other objects, according to one aspect, the disclosure provides an image forming apparatus including a housing, a cover, a process cartridge, an LED array, and a link member. The housing has an opening. The cover is pivotally movable about an axis between an open position at which the cover opens the opening and a closed position at which the cover closes the opening, the axis extending in a first direction. The process cartridge is attachable to and detachable from the housing through the opening in an open state where the cover is at the open position. The process cartridge includes a photosensitive drum and a developing unit configured to supply toner to the photosensitive drum. The LED array is provided at the cover and configured to expose the photosensitive drum to light. The link member is connected to the cover and the developing unit in an attached state where the process cartridge is attached to the housing. The link member is movable in a second direction perpendicular to the first direction in interlocking relation to movement of the cover. The link member is configured to: move the developing unit away from the axis in the second direction during movement of the cover from the closed position to the open position; and move the developing unit toward the axis in the second direction during movement of the cover from the open position to the closed position.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

An image forming apparatus 1 according to one embodiment will be described with reference to FIGS. 1 through 9.

1. Outline of Image Forming Apparatus

Figure 1:
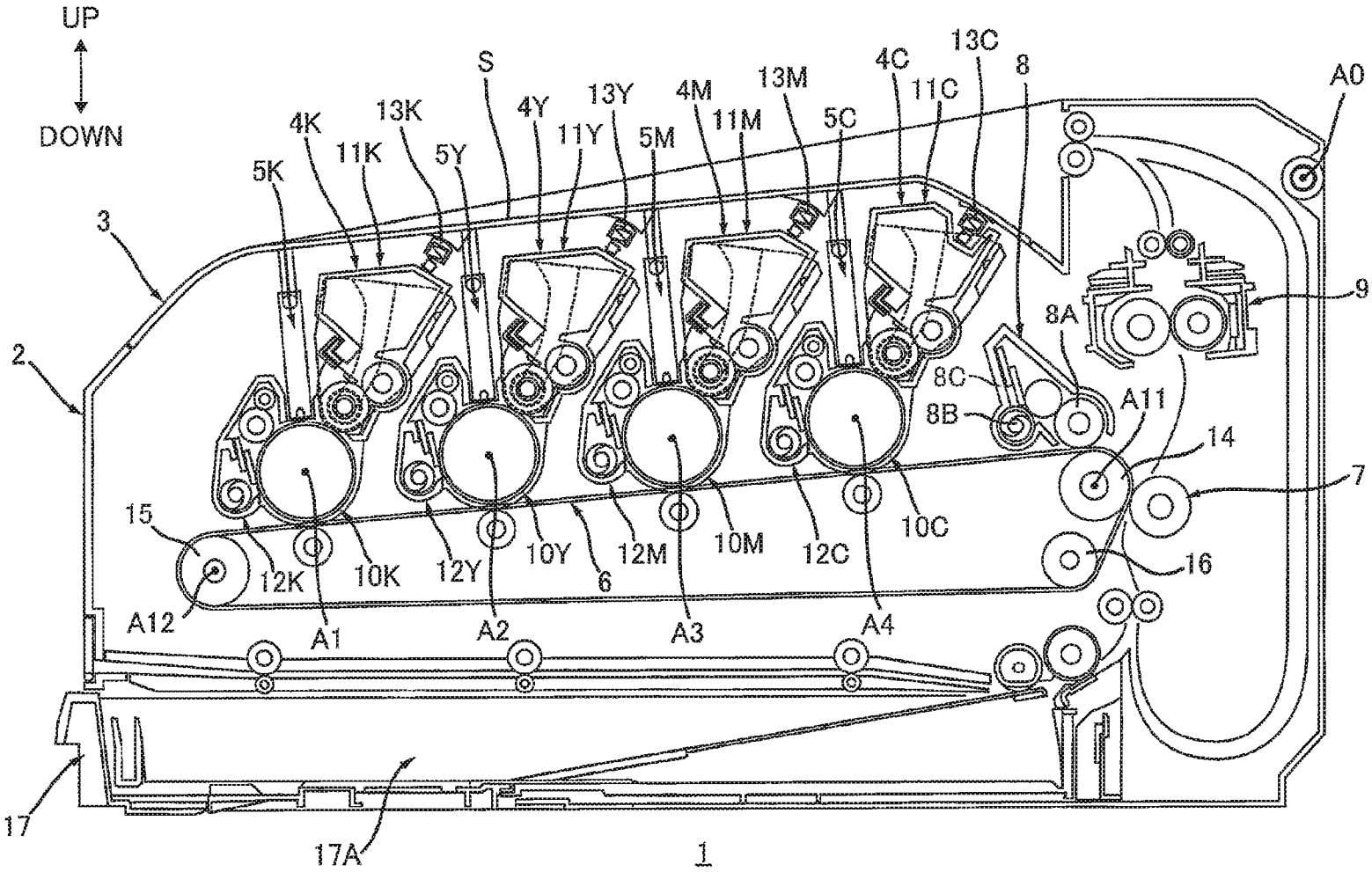
FIG. 1 is a vertical cross-sectional view of an image forming apparatus according to one embodiment.

An outline of the image forming apparatus 1 will be described while referring to FIGS. 1 and 2. As illustrated in FIG. 1, the image forming apparatus 1 includes a housing 2, a cover 3, a plurality of process cartridges 4K, 4Y, 4M, and 4C, a plurality of LED arrays 5K, 5Y, 5M, and 5C, a belt 6, a transfer roller 7, a belt cleaner 8, and a fixing unit 9.

1.1 Housing

The housing 2 constitutes an outer shell of the image forming apparatus 1. The housing 2 has an opening 2A (FIG.

2). The process cartridges 4K, 4Y, 4M, and 4C are accommodated in the housing 2 in an attached state where the process cartridges 4K, 4Y, 4M, and 4C are attached to the housing 2.

1.2 Cover

The cover 3 is pivotally movable about an axis A0 between an open position (FIG. 2) at which the cover 3 opens the opening 2A and a closed position (FIG. 1) at which the cover 3 closes the opening 2A. The axis A0 extends in a first direction. The cover 3 is sloped downward with the increasing distance from the axis A0 in a second direction perpendicular to the first direction in a closed state where the cover 3 is at the closed position. In other words, the cover 3 is inclined downward away from the axis A0 in the second direction in the closed state of the cover 3. Specifically, the cover 3 has an upper surface S sloped downward with the increasing distance from the axis A0 in the second direction in the closed state of the cover 3. In other words, in the closed state of the cover 3, the upper surface S of the cover 3 is inclined downward away from the axis A0 in the second direction. Incidentally, the axis A0 is an imaginary axis. More specifically, the axis A0 is an imaginary axis extending in an extending direction in which a first photosensitive drum 10K described later extends.

1.3 Process Cartridge

Each of the process cartridges 4K, 4Y, 4M, and 4C is attachable to and detachable from the housing 2 through the opening 2A in an open state where the cover 3 is at the open position.

The first process cartridge 4K includes the first photosensitive drum 10K, a first developing unit 11K, and a first cleaner 12K. More specifically, the first process cartridge 4K includes a drum unit 41K (FIG. 4) and the first developing unit 11K, and the drum unit 41K includes the first photosensitive drum 10K and the first cleaner 12K.

The second process cartridge 4Y includes a second photosensitive drum 10Y, a second developing unit 11Y, and a second cleaner 12Y. More specifically, the second process cartridge 4Y includes a drum unit 41Y (FIG. 4) and the second developing unit 11Y, and the drum unit 41Y includes the second photosensitive drum 10Y and the second cleaner 12Y. That is, the image forming apparatus 1 includes the second photosensitive drum 10Y.

The third process cartridge 4M includes a third photosensitive drum 10M, a third developing unit 11M, and a third cleaner 12M. More specifically, the third process cartridge 4M includes a drum unit 41M (FIG. 4) and the third developing unit 11M, and the drum unit 41M includes the third photosensitive drum 10M and the third cleaner 12M.

The fourth process cartridge 4C includes a fourth photosensitive drum 10C, a fourth developing unit 11C, and a fourth cleaner 12C. More specifically, the fourth process cartridge 4C includes a drum unit 41C (FIG. 4) and the fourth developing unit 11C, and the drum unit 41C includes the fourth photosensitive drum 10C and the fourth cleaner 12C.

The process cartridges 4K, 4Y, 4M, and 4C are arrayed in the second direction in the attached state of the process cartridges 4K, 4Y, 4M, and 4C to the housing 2. That is, the first photosensitive drum 10K and the second photosensitive drum 10Y are arrayed in the second direction. The first process cartridge 4K is positioned opposite to the axis A0 with respect to the second process cartridge 4Y in the second direction. That is, the first photosensitive drum 10K is positioned opposite to the axis A0 with respect to the second photosensitive drum 10Y in the second direction. The second process cartridge 4Y is positioned opposite to the axis A0 with respect to the third process cartridge 4M in the second direction. The third process cartridge 4M is positioned opposite to the axis A0 with respect to the fourth process cartridge 4C in the second direction. In the attached state of the process cartridges 4K, 4Y, 4M, and 4C to the housing 2, the process cartridges 4K, 4Y, 4M, and 4C are positioned spaced away from one another in the second direction.

The first photosensitive drum 10K is rotatable about a first axis A1 extending in the first direction. The first photosensitive drum 10K extends along the first axis A1. Incidentally, the first axis A1 is an imaginary axis. Specifically, the first axis A1 is an imaginary axis extending in the extending direction of the first photosensitive drum 10K.

The second photosensitive drum 10Y is rotatable about a second axis A2 extending in the first direction. The second photosensitive drum 10Y extends along the second axis A2. Incidentally, the second axis A2 is an imaginary axis. Specifically, the second axis A2 is an imaginary axis extending in an extending direction in which the second photosensitive drum 10Y extends.

The third photosensitive drum 10M is rotatable about a third axis A3 extending in the first direction. The third photosensitive drum 10M extends along the third axis A3. Incidentally, the third axis A3 is an imaginary axis. Specifically, the third axis A3 is an imaginary axis extending in an extending direction in which the third photosensitive drum 10M extends.

The fourth photosensitive drum 10C is rotatable about a fourth axis A4 extending in the first direction. The fourth photosensitive drum 10C extends along the fourth axis A4. Incidentally, the fourth axis A4 is an imaginary axis. Specifically, the fourth axis A4 is an imaginary axis extending in an extending direction in which the fourth photosensitive drum 10C extends.

The first axis A1 is positioned below the second axis A2. The second axis A2 is positioned below the third axis A3. The third axis A3 is positioned below the fourth axis A4.

The first developing unit 11K is adapted to supply toner to the first photosensitive drum 10K. The first developing unit 11K is attachable to and detachable from the drum unit 41K. Therefore, replacement of only the first developing unit 11K with a new first developing unit 11K can be performed on the first process cartridge 4K without replacing the entire first process cartridge 4K with a new first process cartridge 4K. Similar effect can be obtained with respect to the developing units 11Y, 11M, and 11C. The first developing unit 11K includes a first pressure member 13K. In the closed state of the cover 3, the first pressure member 13K is pressed toward the first photosensitive drum 10K by the cover 3.

The second developing unit 11Y is adapted to supply toner to the second photosensitive drum 10Y. The second developing unit 11Y is attachable to and detachable from the drum unit 41Y. The second developing unit 11Y includes a second pressure member 13Y. In the closed state of the cover 3, the second pressure member 13Y is pressed toward the second photosensitive drum 10Y by the cover 3.

The third developing unit 11M is adapted to supply toner to the third photosensitive drum 10M. The third developing unit 11M is attachable to and detachable from the drum unit 41M. The third developing unit 11M includes a third pressure member 13M. In the closed state of the cover 3, the third pressure member 13M is pressed toward the third photosensitive drum 10M by the cover 3.

The fourth developing unit 11C is adapted to supply toner to the fourth photosensitive drum 10C. The fourth developing unit 11C is attachable to and detachable from the drum unit 41C. The fourth developing unit 11C includes a fourth pressure member 13C. In the closed state of the cover 3, the fourth pressure member 13C is pressed toward the fourth photosensitive drum 10C by the cover 3.

The first cleaner 12K is adapted to remove toner from the peripheral surface of the first photosensitive drum 10K. The second cleaner 12Y is adapted to remove toner from the peripheral surface of the second photosensitive drum 10Y. The third cleaner 12M is adapted to remove toner from the peripheral surface of the third photosensitive drum 10M. The fourth cleaner 12C is adapted to remove toner from the peripheral surface of the fourth photosensitive drum 10C.

1.4 LED Array

The LED arrays 5K, 5Y, 5M, and 5C are provided at the cover 3. Specifically, the LED arrays 5K, 5Y, 5M, and 5C are attached to the cover 3.

The first LED array 5K is adapted to expose the first photosensitive drum 10K to light. In the attached state of the first process cartridge 4K to the housing 2, the first LED array 5K is positioned above the first photosensitive drum 10K and is also positioned opposite to the axis A0 with respect to the first developing unit 11K in the second direction.

The second LED array 5Y is adapted to expose the second photosensitive drum 10Y to light. In the attached state of the second process cartridge 4Y to the housing 2, the second LED array 5Y is positioned above the second photosensitive drum 10Y and is also positioned opposite to the axis A0 with respect to the second developing unit 11Y in the second direction.

The third LED array 5M is adapted to expose the third photosensitive drum 10M to light. In the attached state of the third process cartridge 4M to the housing 2, the third LED array 5M is positioned above the third photosensitive drum 10M and is also positioned opposite to the axis A0 with respect to the third developing unit 11M in the second direction.

The fourth LED array 5C is adapted to expose the fourth photosensitive drum 10C to light. In the attached state of the fourth process cartridge 4C to the housing 2, the fourth LED array 5C is positioned above the fourth photosensitive drum 10C and is also positioned opposite to the axis A0 with respect to the fourth developing unit 11C in the second direction.

1.5 Belt, Transfer Roller, and Belt Cleaner

The belt 6 is positioned below the process cartridges 4K, 4Y, 4M, and 4C in the attached state of the process cartridges 4K, 4Y, 4M, 4C to the housing 2. The belt 6 is an endless belt. A first roller 14, a second roller 15 and a third roller 16 are provided in the housing 2, and the belt 6 is looped over these rollers, so that the belt 6 is circularly movable along these rollers.

The first roller 14 is positioned opposite to the third photosensitive drum 10M with respect to the fourth photosensitive drum 10C in the second direction. The first roller 14 is rotatable about an axis A11 extending in the first direction.

The second roller 15 is positioned away from the first roller 14 in the second direction. More specifically, the second roller 15 is positioned opposite to the second photosensitive drum 10Y with respect to the first photosensitive drum 10K in the second direction. Accordingly, a part of the belt 6 spanning between the first roller 14 and the second roller 15 extends in the second direction. That is, the belt 6 extends in the second direction.

The second roller 15 is rotatable about an axis A12 extending in the first direction. The axis A12 is positioned below the axis A11. Thus, the part of the belt 6 spanning between the first roller 14 and the second roller 15 is sloped downward with the increasing distance from the axis A0 in the second direction. In other words, the part of the belt 6 spanning between the first roller 14 and the second roller 15 is inclined downward away from the axis A0 in the second direction. That is, the belt 6 is sloped downward with the increasing distance from the axis A0 in the second direction. In other words, the belt 6 is inclined downward away from the axis A0 in the second direction.

The third roller 16 is positioned away from the first roller 14 and the second roller 15. Further, the third roller 16 is positioned below the first roller 14. The belt 6 is in contact with the first photosensitive drum 10K, the second photosensitive drum 10Y, the third photosensitive drum 10M, and the fourth photosensitive drum 10C. Toner images formed on the photosensitive drums 10K, 10Y, 10M, and 10C are transferred onto the belt 6.

The transfer roller 7 is adapted to transfer the toner images that have been transferred onto the belt 6 onto the sheet. The transfer roller 7 and the first roller 14 are arrayed in the second direction. Specifically, the transfer roller 7 is positioned opposite to the second roller 15 with respect to the first roller 14 in the second direction. The transfer roller 7 is in contact with the belt 6. The belt 6 passes through a portion between the first roller 14 and the transfer roller 7.

The belt cleaner 8 is adapted to remove toner from the surface of the belt 6. The belt cleaner 8 is positioned opposite to the third process cartridge 4M with respect to the fourth process cartridge 4C in the second direction. The belt cleaner 8 is positioned above the belt 6.

The belt cleaner 8 includes a cleaning roller 8A, an auger 8B, and a casing 8C. The cleaning roller 8A is in contact with the surface of the belt 6 and is adapted to remove toner from the surface of the belt 6. The toner that has been removed from the surface of the belt 6 by the cleaning roller 8A is accommodated in an inside of the casing 8C of the belt cleaner 8. The auger 8B is positioned inside the casing 8C of the belt cleaner 8. The auger 8B extends in the first direction and is adapted to convey the toner accommodated in the casing 8C in the first direction.

1.6 Fixing Unit

The fixing unit 9 is adapted to fix the toner image to the sheet by heating and pressing the sheet onto which the toner image has been transferred. The fixing unit 9 is positioned above the transfer roller 7 and is spaced away from the transfer roller 7 in a vertical direction (i.e., an upward/downward direction).

1.7 Sheet Tray

The image forming apparatus 1 further includes a sheet tray 17. The sheet tray 17 is positioned below the belt 6, and is adapted to accommodate therein sheets. Each one of the sheets accommodated in the sheet tray 17 is supplied to a portion between the belt 6 and the transfer roller 7 at a prescribed timing. Further, the sheet tray 17 is movable relative to the housing 2 in the second direction. More specifically, the sheet tray 17 includes a sheet accommodating portion 17A for accommodating therein the sheets. The sheet tray 17 is movable between an outside position at which the sheet accommodating portion 17A is positioned outside the housing 2 and an inside position at which the sheet accommodating portion 17A is positioned inside the housing 2. The outside position of the sheet tray 17 is farther from the axis A0 in the second direction than the inside position of the sheet tray 17 is from the axis A0. Thus, a user can operate the sheet tray 17 from one side of the housing 2 which is farther from the axis A0 in the second direction. Specifically, the user can replenish sheets to the sheet accommodating portion 17A after moving the sheet tray 17 to the outside position.

1.8 Conveyer Tube and Waste Toner Cartridge

Figure 3:
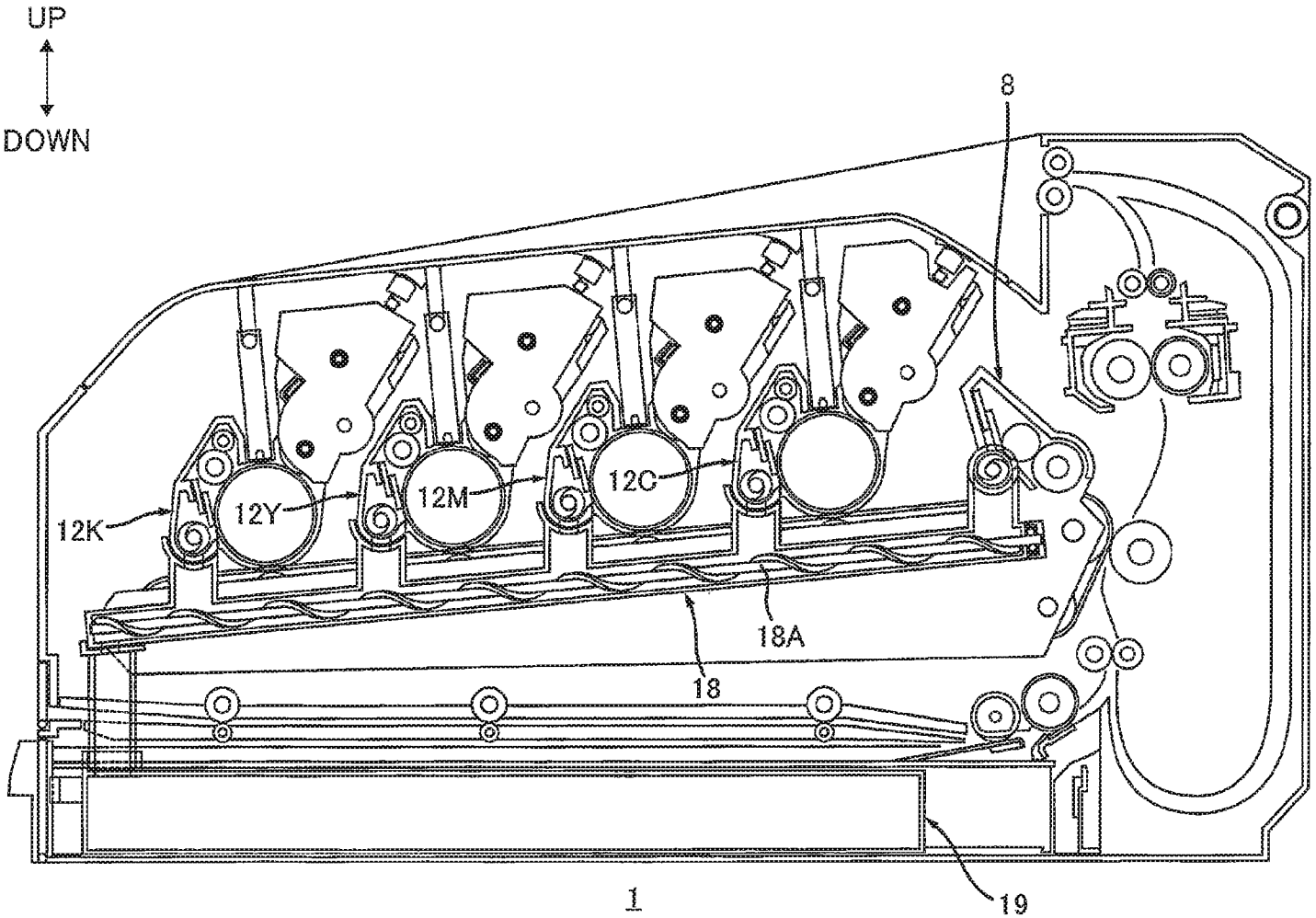
FIG. 3 is a view for description of a conveyer tube and a waste toner cartridge in the image forming apparatus according to the embodiment.
Figure 5:
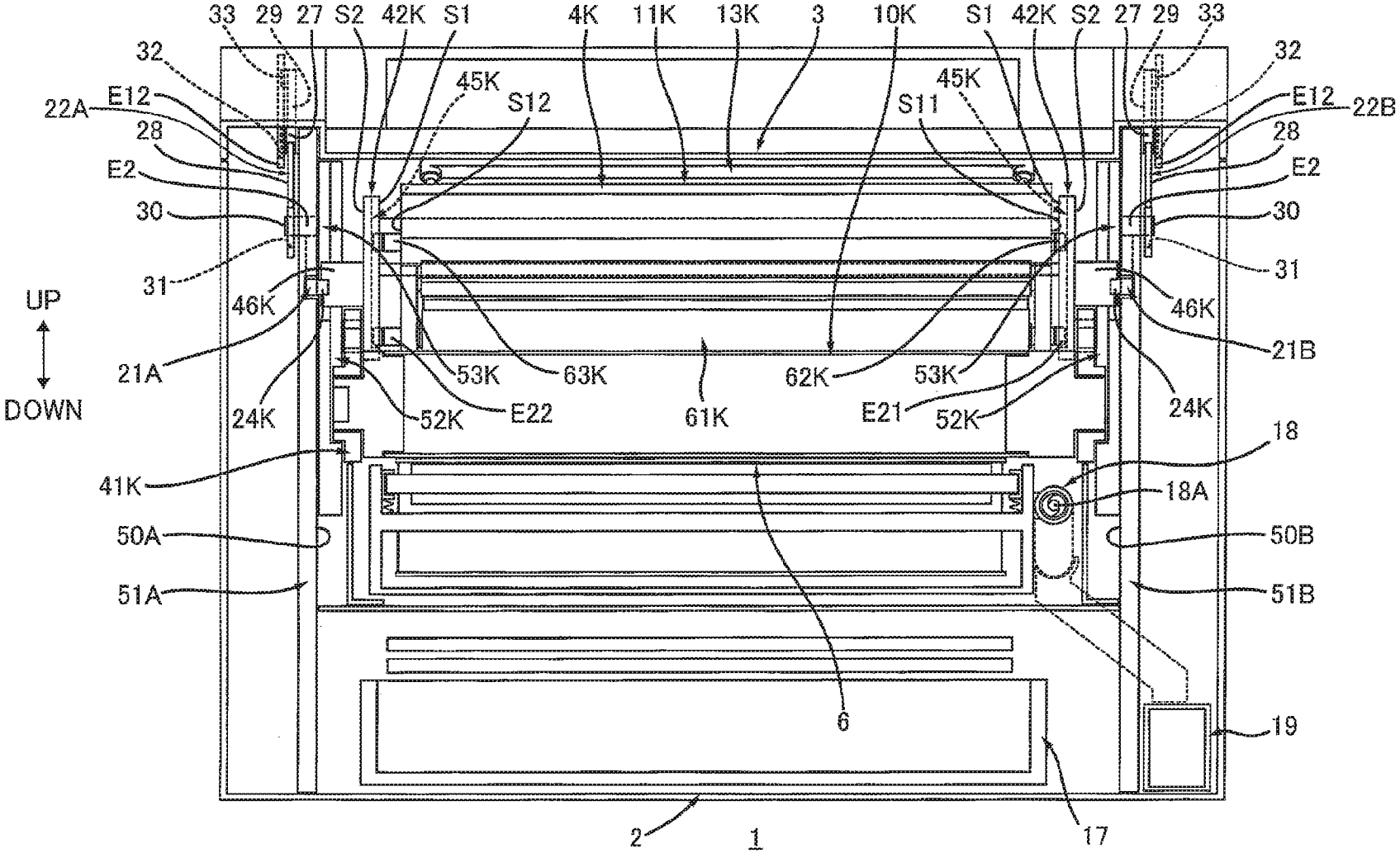
FIG. 5 is a cross-sectional view taken along a line V-V in FIG. 4.

As illustrated in FIGS. 3 and 5, the image forming apparatus 1 further includes a conveyer tube 18 and a waste toner cartridge 19.

The conveyer tube 18 is for conveying toner that has been removed by the first cleaner 12K, the second cleaner 12Y, the third cleaner 12M, the fourth cleaner 12C, and the belt cleaner 8. The conveyer tube 18 is positioned below the cleaners 12K, 12Y, 12M, 12C and the belt cleaner 8. Incidentally, the conveyer tube 18 and the belt 6 are arrayed in the first direction (FIG. 5). The conveyer tube 18 extends in the second direction. Further, the conveyer tube 18 is sloped downward with the increasing distance from the axis A0 in the second direction. In other words, the conveyer tube 18 is inclined downward away from the axis A0 in the second direction.

The conveyer tube 18 has one end portion and another end portion in the second direction. The one end portion is positioned closer to the axis A0 in the second direction than the other end portion is to the axis A0. The one end portion is fluidly connected to the belt cleaner 8. Hence, the conveyer tube 18 can receive toner accommodated in the belt cleaner 8. Further, the conveyer tube 18 is fluidly connected to the cleaners 12K, 12Y, 12M, and 12C at positions between the one end portion and the other end portion. Hence, the conveyer tube 18 can receive toner accommodated in each of the cleaners 12K, 12Y, 12M, and 12C. Further, an auger 18A is provided in the conveyer tube 18. The auger 18A extends in the second direction along the conveyer tube 18. The auger 18A is adapted to convey toner accommodated in the conveyer tube 18 in the second direction.

The waste toner cartridge 19 is adapted to accommodate toner that has been conveyed by the auger 18A of the conveyer tube 18. The waste toner cartridge 19 is attachable to and detachable from the housing 2. In an attached state where the waste toner cartridge 19 is attached to the housing 2, the waste toner cartridge 19 is positioned below the conveyer tube 18. Incidentally, in the attached state of the waste toner cartridge 19 to the housing 2, the waste toner cartridge 19 and the sheet tray 17 are arrayed in the first direction (FIG. 5).

Further, in the attached state of the waste toner cartridge 19 to the housing 2, the waste toner cartridge 19 is fluidly connected to the other end portion of the conveyer tube 18. Thus, in the attached state of the waste toner cartridge 19 to the housing 2, the waste toner cartridge 19 can receive toner that has been conveyed by the auger 18A of the conveyer tube 18.

Moreover, the waste toner cartridge 19 is movable in the second direction during attachment and detachment of the waste toner cartridge 19 to and from the housing 2. More specifically, for detaching the waste toner cartridge 19 from the housing 2, the waste toner cartridge 19 is moved away from the axis A0 in the second direction. On the other hand, for attaching the waste toner cartridge 19 to the housing 2, the waste toner cartridge 19 is moved toward the axis A0 in the second direction. Accordingly, the user can operate the waste toner cartridge 19 from the one side of the housing 2 which is farther from the axis A0 in the second direction.

2. Details of Image Forming Apparatus

Figure 2:
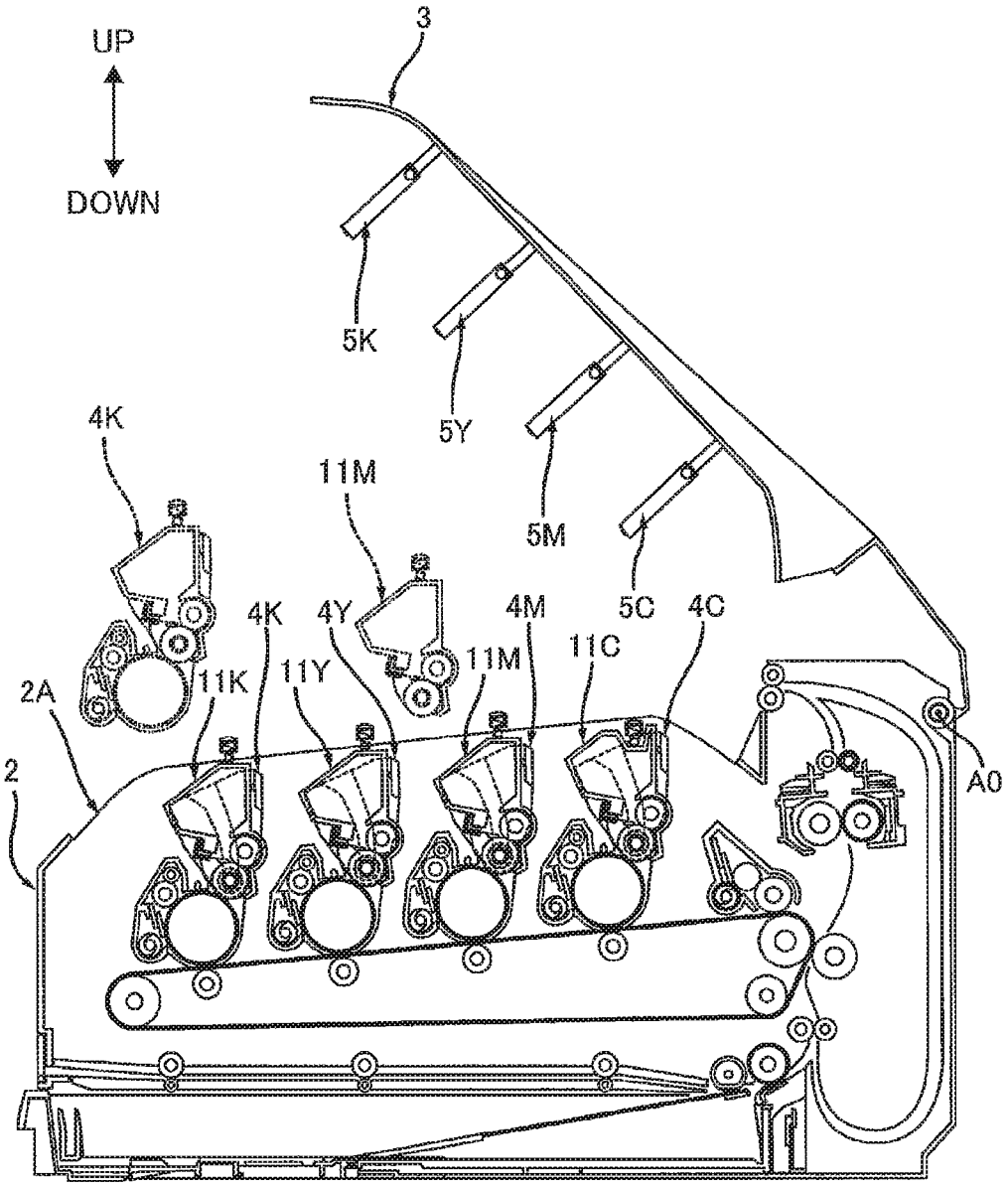
FIG. 2 is a vertical cross-sectional view of the image forming apparatus according to the embodiment, and particularly illustrating a state where a cover is at an open position.

As illustrated in FIGS. 1 and 2, the image forming apparatus 1 is adapted to move the developing units 11K, 11Y, 11M, and 11C away from the axis A0 in the second direction during movement of the cover 3 from the closed position to the open position in the attached state of the process cartridges 4K, 4Y, 4M, and 4C to the housing 2. The image forming apparatus 1 is further adapted to move the developing units 11K, 11Y, 11M, and 11C toward the axis A0 in the second direction during movement of the cover 3 from the open position to the closed position in the attached state of the process cartridges 4K, 4Y, 4M, and 4C to the housing 2. Details of the image forming apparatus 1 will be described with reference to FIGS. 4 through 7.

Figure 4:
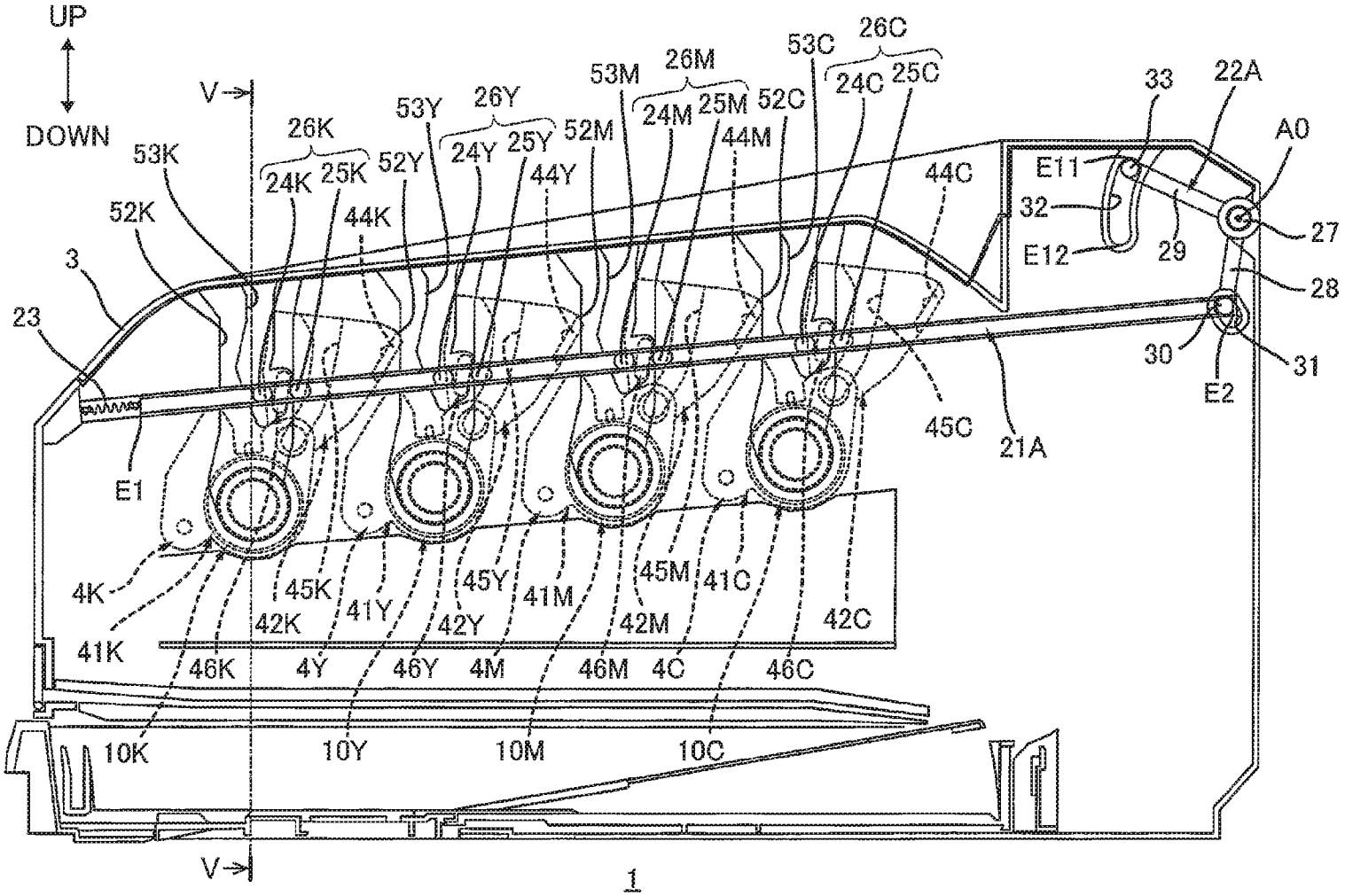
FIG. 4 is a view for description of interlocking movement between opening/closing motion of the cover and a motion of a link member in the image forming apparatus according to the embodiment, and particularly illustrating a state where the cover is at a closed position.

As illustrated in FIGS. 4 and 5, the housing 2 includes two side walls 51A and 51B, two link members 21A and 21B, and two connection members 22A and 22B. That is, the image forming apparatus 1 includes the two link members 21A and 21B.

2.1 Side Walls

As illustrated in FIG. 5, the side walls 51A and 51B are positioned away from each other in the first direction. The side walls 51A and 51B extend in the vertical direction. In the attached state of the process cartridges 4K, 4Y, 4M, and 4C to the housing 2, the process cartridges 4K, 4Y, 4M, and 4C are positioned between the side walls 51A and 51B in the first direction.

The side wall 51A has an inner surface 50A, and the side wall 51B has an inner surface 50B. In the attached state of the process cartridges 4K, 4Y, 4M, and 4C to the housing 2, the inner surfaces 50A and 50B face a set of the process cartridges 4K, 4Y, 4M, and 4C in the first direction.

Here, the side wall 51B has a structure identical to that of the side wall 51A. Therefore, hereinafter, only the side wall 51A will be described. As illustrated in FIG. 4, the side wall 51A has a plurality of first process guides 52K, 52Y, 52M, and 52C and a plurality of second process guides 53K, 53Y, 53M, and 53C.

As illustrated in FIGS. 4 and 5, the first process guides 52K, 52Y, 52M, and 52C are positioned at the inner surface 50A of the side wall 51A. The first process guide 52K is adapted to guide the first photosensitive drum 10K during attachment and detachment of the first process cartridge 4K to and from the housing 2. The first process guide 52Y is adapted to guide the second photosensitive drum 10Y during attachment and detachment of the second process cartridge 4Y to and from the housing 2. The first process guide 52M is adapted to guide the third photosensitive drum 10M during attachment and detachment of the third process cartridge 4M to and from the housing 2. The first process guide 52C is adapted to guide the fourth photosensitive drum 10C during attachment and detachment of the fourth process cartridge 4C to and from the housing 2. The first process guides 52K, 52Y, 52M, and 52C extend in the vertical direction.

As illustrated in FIG. 4, the second process guide 53K is positioned inward of the first process guide 52K as viewed in the first direction. The second process guide 53K is adapted to guide a protrusion 46K (described later) of the first process cartridge 4K during attachment and detachment of the first process cartridge 4K to and from the housing 2. The second process guide 53Y is positioned inward of the first process guide 52Y as viewed in the first direction. The second process guide 53Y is adapted to guide a protrusion 46Y (described later) of the second process cartridge 4Y during attachment and detachment of the second process cartridge 4Y to and from the housing 2. The second process guide 53M is positioned inward of the first process guide 52M as viewed in the first direction. The second process guide 53M is adapted to guide a protrusion 46M (described later) of the third process cartridge 4M during attachment and detachment of the third process cartridge 4M to and from the housing 2. The second process guide 53C is positioned inward of the first process guide 52C as viewed in the first direction. The second process guide 53C is adapted to guide a protrusion 46C (described later) of the fourth process cartridge 4C during attachment and detachment of the fourth process cartridge 4C to and from the housing 2. The second process guides 53K, 53Y, 53M, and 53C extend in the vertical direction.

2.2 Link Members

As illustrated in FIG. 5, each of the link members 21A and 21B is positioned in the housing 2. As illustrated in FIG. 4, as viewed in the first direction, the link member 21A has a rectangular shape whose longest side extends in the second direction. Also, the link member 21B is the same in shape as that of the link member 21A when viewed in the first direction. That is, as viewed in the first direction, the link member 21B has a rectangular shape whose longest side extends in the second direction. Each of the link members 21A and 21B has a uniform length in a third direction perpendicular to the first direction and the second direction. In the present embodiment, the third direction is identical to the vertical direction (i.e., the upward/downward direction). The link member 21A is supported to the inner surface 50A of the side wall 51A, and the link member 21B is supported to the inner surface 50B of the side wall 51B. Hence, the link members 21A and 21B are provided away from each other in the first direction. In the attached state of the process cartridges 4K, 4Y, 4M, and 4C to the housing 2, the developing units 11K, 11Y, 11M, and 11C are positioned between the link members 21A and 21B in the first direction.

Figure 6:
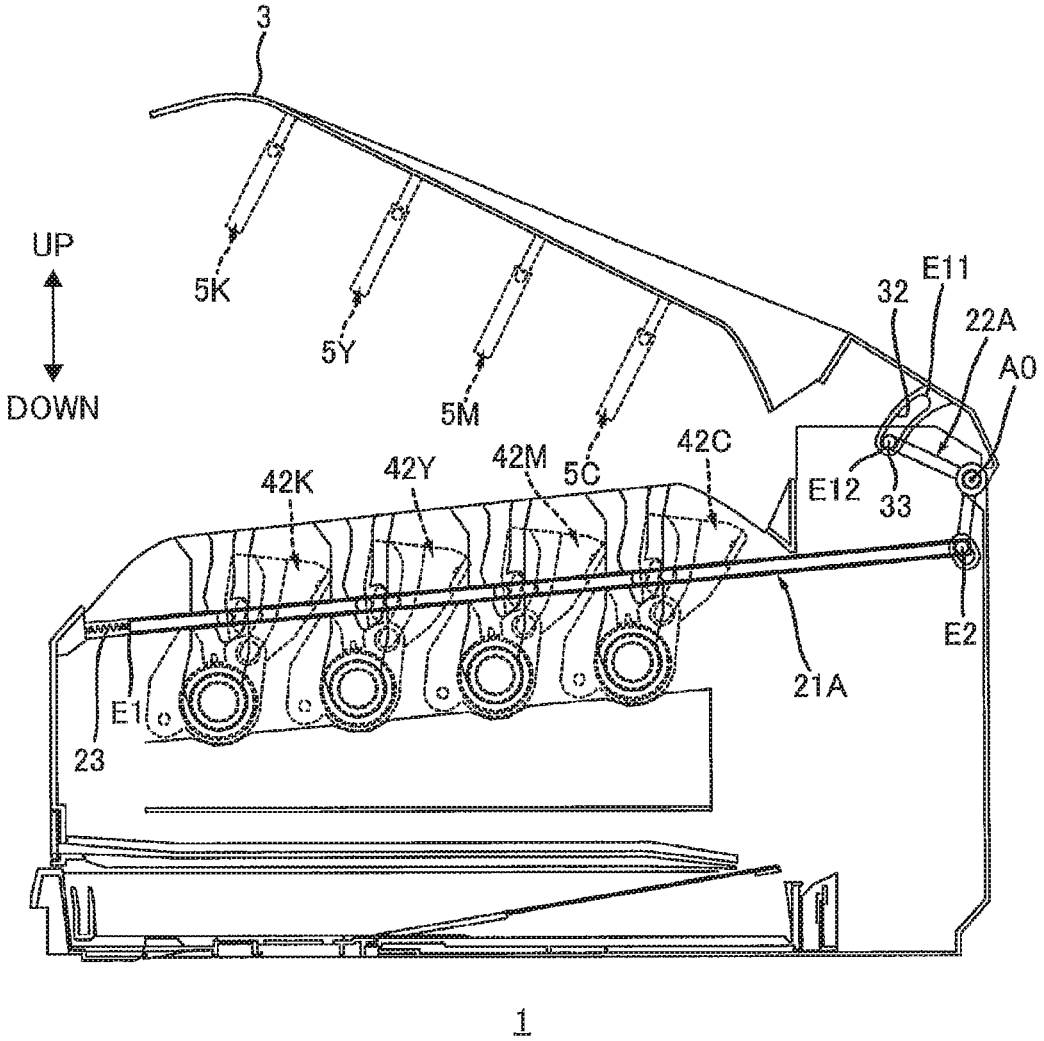
FIG. 6 is a view for description of the interlocking movement following the movement illustrated in FIG. 4 in the image forming apparatus according to the embodiment, and particularly illustrating a state where the cover is at an interlocking position of the cover.
Figure 7:
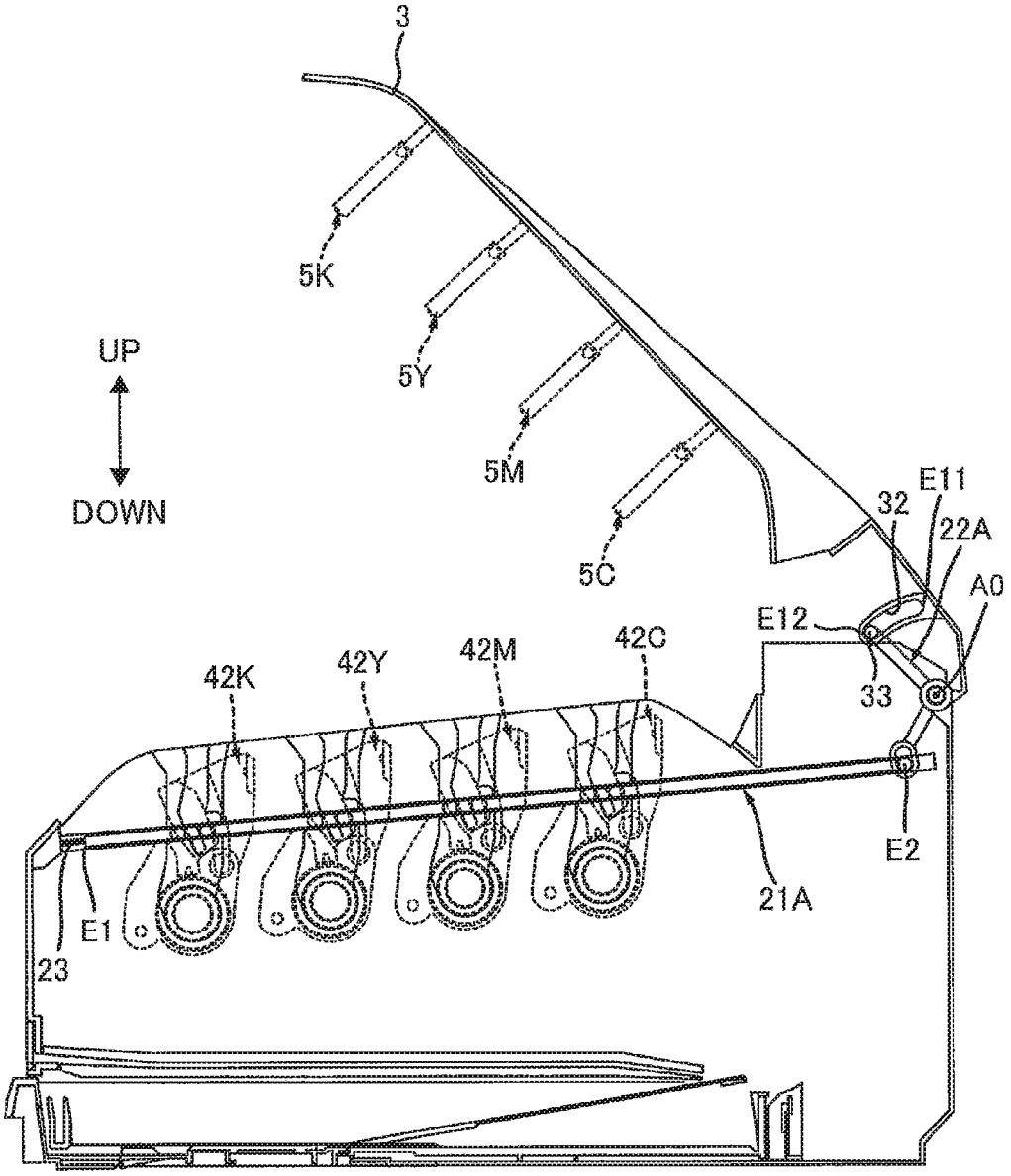
FIG. 7 is a view for description of the interlocking movement following the movement illustrated in FIG. 6 in the image forming apparatus according to the embodiment, and particularly illustrating the state where the cover is at the open position.

Further, as illustrated in FIGS. 4, 6, and 7, the link members 21A and 21B are movable in the second direction in interlocking relation to movement of the cover 3. The link members 21A and 21B are adapted to, in cooperation with each other, move the developing units 11K, 11Y, 11M, and 11C (see FIGS. 1 and 2) away from the axis A0 in the second direction during movement of the cover 3 from the closed position (see FIG. 4) to the open position (see FIG. 7). Further, the link members 21A and 21B are adapted to, in cooperation with each other, move the developing units 11K, 11Y, 11M, and 11C toward the axis A0 in the second direction during movement of the cover 3 from the open position to the closed position. Since the developing units 11K, 11Y, 11M, and 11C is moved in the second direction by the link members 21A and 21B which are spaced away from each other in the first direction, the developing units 11K, 11Y, 11M, 11C can be prevented from being inclined with respect to the first direction during the movement in the second direction of the developing units 11K, 11Y, 11M, and 11C. Thus, smooth movement in the second direction of the developing units 11K, 11Y, 11M, and 11C can be obtained.

Here, the link members 21A and 21B are identical to each other in structure. Therefore, hereinafter, only the structure of the link member 21A will be described in detail.

As illustrated in FIG. 4, the link member 21A extends in the second direction, and is movable in the second direction. The link member 21A has one end portion E1 and another end portion E2 in the second direction. The one end portion E1 is positioned farther from the axis A0 than the other end portion E2 is from the axis A0.

As illustrated in FIGS. 6 and 7, a spring 23 is attached to the one end portion E1. The spring 23 is compressed in accordance with the movement of the link member 21A away from the axis A0 in the second direction. The link member 21A is urged toward the axis A0 in the second direction by the compression of the spring 23.

As illustrated in FIG. 4, the other end portion E2 is provided with a boss 30 extending in the first direction. The boss 30 has a solid cylindrical shape. The boss 30 is inserted into a hole 31 (described later) of the connection member 22A. Thus, the other end portion E2 of the link member 21A is connected to the connection member 22A. Incidentally, the connection member 22A is connected to the cover 3. Therefore, the link member 21A is connected to the cover 3 through the connection member 22A.

As illustrated in FIGS. 4 and 5, the link member 21A is provided with a plurality of engagement portions 26K, 26Y, 26M, and 26C. The engagement portions 26K, 26Y, 26M, and 26C are arrayed in the second direction, and are spaced away from each other in the second direction.

The engagement portion 26K is adapted to be engaged with the protrusion 46K (described later) in the attached state of the first process cartridge 4K to the housing 2. The engagement portion 26Y is adapted to be engaged with the protrusion 46Y (described later) in the attached state of the second process cartridge 4Y to the housing 2. The engagement portion 26M is adapted to be engaged with the protrusion 46M (described later) in the attached state of the third process cartridge 4M to the housing 2. The engagement portion 26C is adapted to be engaged with the protrusion 46C (described later) in the attached state of the fourth process cartridge 4C to the housing 2.

The engagement portion 26K includes a first boss 24K and a second boss 25K. The engagement portion 26Y includes a first boss 24Y and a second boss 25Y. The engagement portion 26M includes a first boss 24M and a second boss 25M. The engagement portion 26C includes a first boss 24C and a second boss 25C.

Here, the first bosses 24Y, 24M, and 24C are identical to the first boss 24K in shape, and the second bosses 25Y, 25M, and 25C are identical to the second boss 25K in shape. Therefore, in the following description, only the structures of the first boss 24K and the second boss 25K will be described in detail.

Each of The first boss 24K and the second boss 25K has a solid cylindrical shape extending in the first direction. The first boss 24K and the second boss 25K are positioned away from each other in the second direction. In the attached state of the first process cartridge 4K to the housing 2, the first boss 24K and the second boss 25K protrude from the link member 21A toward the first process cartridge 4K in the first direction. In the attached state of the first process cartridge 4K to the housing 2, the protrusion 46K is positioned between the first boss 24K and the second boss 25K. Thus, in the attached state of the first process cartridge 4K to the housing 2, the engagement portion 26K is engaged with the protrusion 46K. Accordingly, in the attached state of the first process cartridge 4K to the housing 2, the link member 21A is connected to the first developing unit 11K through a guide member 42K (described later). The link member 21A moves the first developing unit 11K by moving the guide member 42K.

2.3 Connection Member

As illustrated in FIGS. 4 and 5, the connection member 22A connects the link member 21A to the cover 3, and the connection member 22B connects the link member 21B to the cover 3. Incidentally, the connection member 22B has a structure the same as that of the connection member 22A. Therefore, in the following description, only the connection member 22A will be described in detail. The connection member 22A includes a pivot shaft 27, a first connecting member 28, and a second connecting member 29.

The pivot shaft 27 extends along the axis A0, and has a cylindrical shape. The pivot shaft 27 is supported to the side wall 51A so as to be rotatable relative thereto.

The first connecting member 28 is connected to the link member 21A. The first connecting member 28 extends from the pivot shaft 27 toward the other end portion E2 of the link member 21A. The first connecting member 28 has the hole 31 into which the boss 30 of the link member 21A is inserted. Thus, the first connecting member 28 is connected to the other end portion E2 of the link member 21A.

The second connecting member 29 is connected to the cover 3. The cover 3 has an elongated slot 32, and the second connecting member 29 extends from the pivot shaft 27 toward the elongated slot 32. The elongated slot 32 extends in a pivotally moving direction in which the cover 3 is pivotally moved. The second connecting member 29 has a boss 33. The boss 33 extends in the first direction and has a solid cylindrical shape. The boss 33 is inserted into the elongated slot 32. Thus, the second connecting member 29 is connected to the cover 3.

Here, the elongated slot 32 has one end E11 and another end E12 in the pivotally moving direction of the cover 3. The other end E12 is positioned upstream of the one end E11 in a pivotally moving direction in which the cover 3 is pivotally moved from the closed position to the open position. Further, in the closed state of the cover 3, the boss 33 of the second connecting member 29 is inserted into the elongated slot 32 and is positioned close to or in contact with the one end E11 of the elongated slot 32. Thus, as illustrated in FIGS. 4 and 6, during the pivotal movement of the cover 3 from the closed position to the open position, the connection member 22A is not pivotally moved until the other end E12 of the elongated slot 32 reaches the boss 33. That is, in spite of the pivotal movement of the cover 3 from the closed position to the open position, the connection member 22A is not pivotally moved until the other end E12 of the elongated slot 32 reaches the boss 33.

As illustrated in FIGS. 6 and 7, when the cover 3 is further pivotally moved toward the open position after the cover 3 is pivotally moved until the other end E12 of the elongated slot 32 reaches the boss 33, the connection member 22A is pivotally moved about the axis A0 in conjunction with the pivotal movement of the cover 3. By this pivotal movement of the connection member 22A, the link member 21A is moved away from the axis A0 in the second direction. That is, when the cover 3 is further pivotally moved toward the open position after the cover 3 is pivotally moved until the other end E12 of the elongated slot 32 reaches the boss 33, the cover 3 and the link member 21A are moved in interlocking relation to each other. A position at which the interlocking movement between the cover 3 and the link member 21A is started will be referred to as an "interlocking position" of the cover 3 (See FIG. 6). That is, the cover 3 is moved from the closed position to the open position via the interlocking position.

The LED arrays 5K, 5Y, 5M, and 5C are positioned outside of the housing 2 in a state where the cover 3 is at the interlocking position. In the housing 2, the link members 21A and 21B move the developing units 11K, 11Y, 11M, and 11C (See FIGS. 1 and 2) during movement of the cover 3 from the interlocking position to the open position. Thus, the developing units 11K, 11Y, 11M, and 11C can be moved in a state where the LED arrays 5K, 5Y, 5M, and 5C are positioned outside of the housing 2. As a result, the developing units 11K, 11Y, 11M, and 11C can be prevented from colliding (or interfering) with the corresponding LED arrays 5K, 5Y, 5M, and 5C, respectively.

3. Details of Process Cartridge

Next, details of the process cartridges 4K, 4Y, 4M, and 4C will be described with reference to FIGS. 4, 5, 8A, 8B, and 9.

Figure 8B:
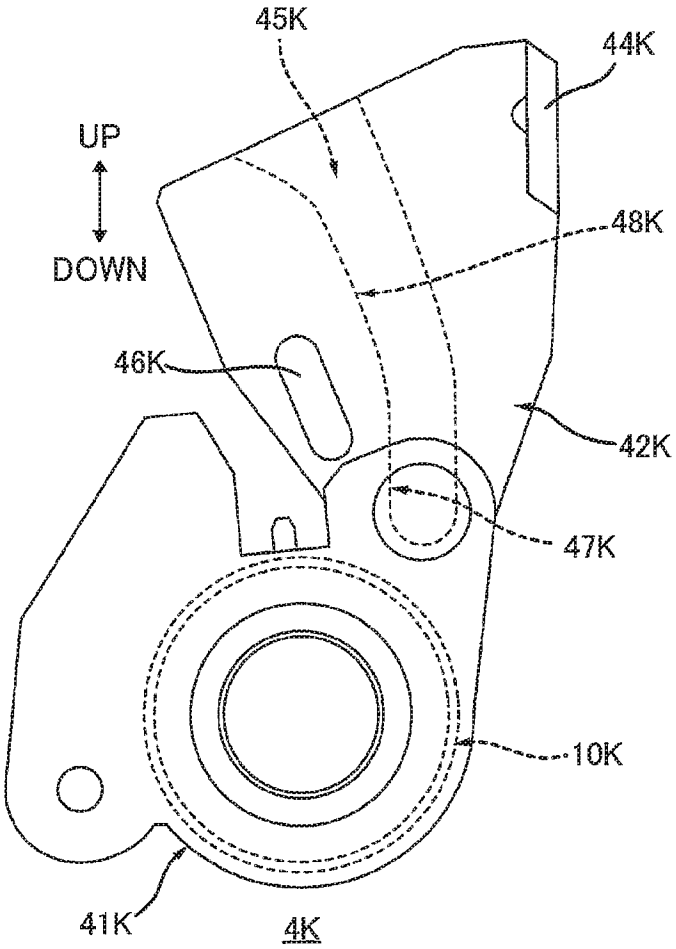
FIG. 8B is a view for description of the process cartridge and particularly illustrating the cartridge a state where the process cartridge is attached to the housing and the cover is at the open position.
Figure 8A:
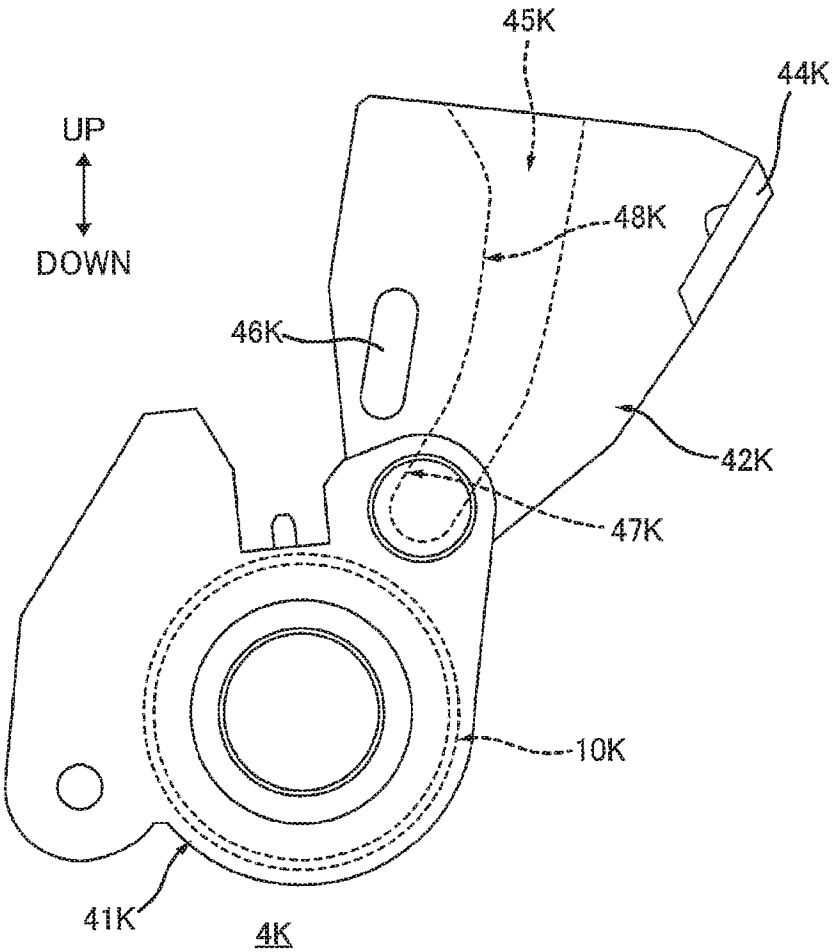
FIG. 8A is a view for description of a process cartridge and particularly illustrating a state where the process cartridge is attached to the housing and the cover is at the closed position.

As illustrated in FIGS. 4, 8A, and 8B, The first process cartridge 4K includes the drum unit 41K, the two guide members 42K, and a connection wall 44K. The drum unit 41K includes the first photosensitive drum 10K and the first cleaner 12K. The second process cartridge 4Y includes the drum unit 41Y, two guide members 42Y, and a connection wall 44Y. The drum unit 41Y includes the second photosensitive drum 10Y and the second cleaner 12Y. The third process cartridge 4M includes the drum unit 41M, two guide members 42M, and a connection wall 44M. The drum unit 41M includes the third photosensitive drum 10M and the third cleaner 12M. The fourth process cartridge 4C includes the drum unit 41C, two guide members 42C, and a connection wall 44C. The drum unit 41C includes the fourth photosensitive drum 10C and the fourth cleaner 12C.

3.1 Guide Member and Connection Wall

As illustrated in FIGS. 4 and 5, the two guide members 42K are adapted to guide attachment and detachment of the first developing unit 11K to and from the drum unit 41K. Each of the two guide members 42K is provided with a developing guide 45K and the protrusion 46K. The two guide members 42Y are adapted to guide attachment and detachment of the second developing unit 11Y to and from the drum unit 41Y. Each of the two guide members 42Y is provided with a developing guide 45Y and the protrusion 46Y. The two guide members 42M are adapted to guide attachment and detachment of the third developing unit 11M to and from the drum unit 41M. Each of the two guide members 42M is provided with a developing guide 45M and the protrusion 46M. The two guide members 42C are adapted to guide attachment and detachment of the fourth developing unit 11C to and from the drum unit 41C. Each of the two guide members 42C is provided with a developing guide 45C and the protrusion 46C.

Incidentally, each of the process cartridges 4Y, 4M, and 4C has a structure the same as that of the first process cartridge 4K. Therefore, in the following description, only the structure of the first process cartridge 4K will be described in detail.

As illustrated in FIG. 5, the two guide members 42K are spaced away from each other in the first direction. Each of the two guide members 42K extends in a direction perpendicular to the first axis A1 about which the first photosensitive drum 10K is rotatable. Each of the two guide members 42K extends in the vertical direction in the attached state of the first process cartridge 4K to the housing 2. Each of the two guide members 42K is plate-shaped, and is pivotally movable relative to the drum unit 41K.

The developing guide 45K is positioned at an inner surface S1 of the guide member 42K. As illustrated in FIGS. 8A and 8B, the developing guide 45K includes a first part 47K and a second part 48K. That is, each of the two guide members 42K includes the first part 47K and the second part 48K. The second part 48K is positioned opposite to the first photosensitive drum 10K with respect to the first part 47K.

As illustrated in FIG. 8A, in a state where the first process cartridge 4K is attached to the housing 2 and the cover 3 is at the closed position, the first part 47K extends in a direction toward the axis A0 (FIG. 4), that is, the first part 47K is inclined with respect to the vertical direction in such a manner that the upper end portion of the first part 47K is closer to the axis A0 in the second direction than the lower end portion of the first part 47K is to the axis A0, and the second part 48K extends in the vertical direction.

Further, as illustrated in FIG. 8B, in a state where the first process cartridge 4K is attached to the housing 2 and the cover 3 is at the open position, the first part 47K extends in the vertical direction, and the second part 48K extends from the upper end portion of the first part 47K in a direction away from the axis A0 (FIG. 4), that is, the second part 48K is inclined with respect to the vertical direction in such a manner that the upper end portion of the second part 48K is farther from the axis A0 in the second direction than the lower end portion of the second part 48K is from the axis A0. Thus, in the state where the first process cartridge 4K is attached to the housing 2 and the cover 3 is at the open position, the two guide members 42K guide the first developing unit 11K in the direction away from the axis A0 during detachment of the first developing unit 11K from the drum unit 41K.

As illustrated in FIG. 5, the protrusion 46K is positioned at an outer surface S2 of the guide member 42K. The protrusion 46K extends in the first direction. Specifically, the protrusion 46K protrudes outward from the outer surface S2 in the first direction. Further, as illustrated in FIGS. 8A and 8B, the protrusion 46K extends in the vertical direction in the attached state of the first process cartridge 4K to the housing 2. That is, the protrusion 46K has an elliptic columnar shape extending in the first direction.

The connection wall 44K is connected to the two guide members 42K, and is positioned between the two guide members 42K. The connection wall 44K extends in the first direction. The connection wall 44K has one end and another end in the first direction. The one end of the connection wall 44K is connected to one of the two guide members 42K, while the other end of the connection wall 44K is connected to remaining one of the guide members 42K. By virtue of this connection of the connection wall 44K with the two guide members 42K, the two guide members 42K are simultaneously pivotally movable relative to the drum unit 41K.

3.2 Details of Developing Unit

Details of the first developing unit 11K will next be described with reference to FIGS. 5 and 9. Incidentally, each of the developing units 11Y, 11M, and 11C has a structure the same as that of the first developing unit 11K. Therefore, in the following description, only the structure of the first developing unit 11K will be described in detail.

Figure 9:
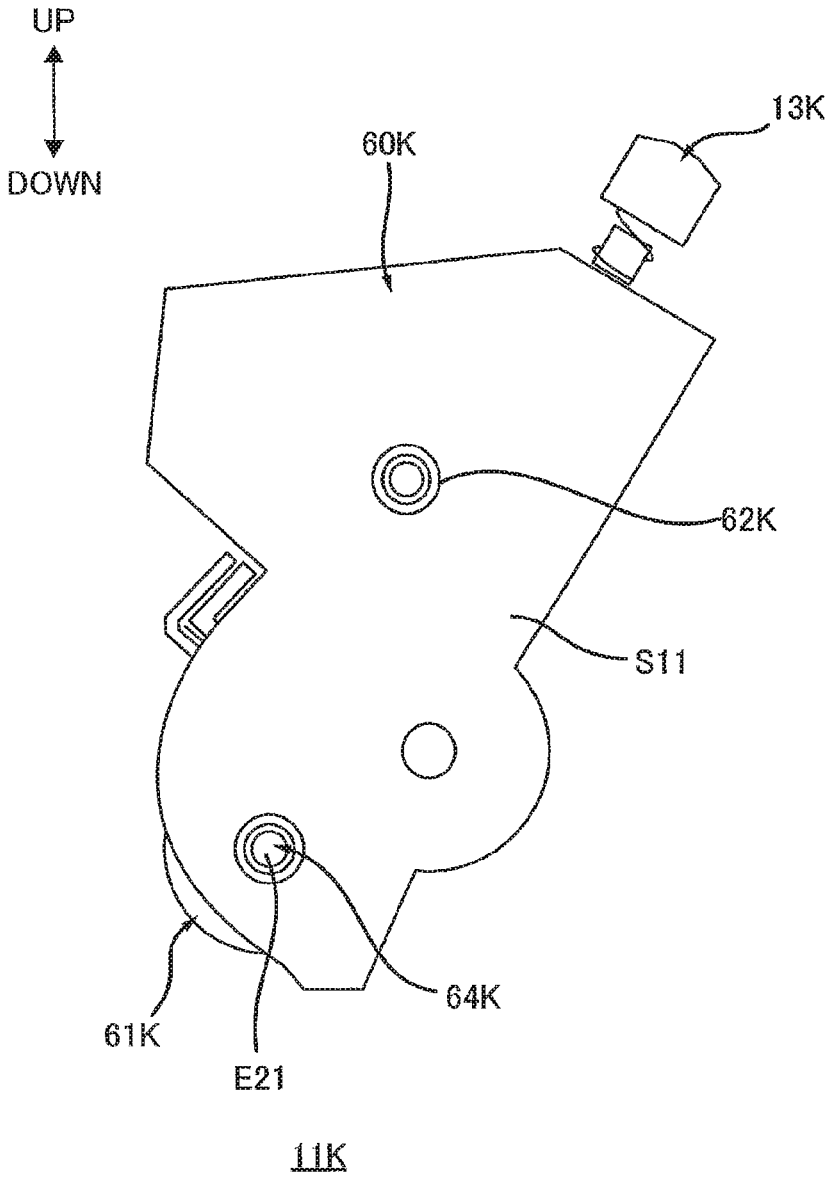
FIG. 9 is a side view of a developing unit in the image forming apparatus according to the embodiment.

As illustrated in FIG. 9, the first developing unit 11K includes a casing 60K, a developing roller 61K, and two guide protrusions 62K and 63K. The casing 60K is adapted to accommodate therein toner, and extends in the first direction. As illustrated in FIG. 5, the casing 60K has one outer surface S11 and another outer surface S12 in the first direction.

In an attached state where the first developing unit 11K is attached to the drum unit 41K, the developing roller 61K is in contact with the first photosensitive drum 10K. Therefore, the developing roller 61K can supply toner accommodated in the first developing unit 11K to the first photosensitive drum 10K.

The developing roller 61K includes a developing roller shaft 64K extending in the first direction. The developing roller shaft 64K has one end portion E21 and another end portion E22 in the first direction.

The one end portion E21 protrudes outward from the one outer surface S11 of the casing 60K, and the other end portion E22 protrudes outward from the other outer surface S12 of the casing 60K. The one end portion E21 is guided by the developing guide 45K of one of the guide members 42K during attachment and detachment of the first developing unit 11K to and from the drum unit 41K. The other end portion E22 is guided by the developing guide 45K of remaining one of the guide members 42K during the attachment and detachment of the first developing unit 11K to and from the drum unit 41K.

Each of the guide protrusions 62K and 63K is positioned between the developing roller shaft 64K and the first pressure member 13K. The guide protrusion 62K protrudes outward from the one outer surface S11, while the guide protrusion 63K protrudes outward from the other outer surface S12. The guide protrusions 62K and 63K are cylindrical in shape. The guide protrusion 62K is guided by the developing guide 45K of the one of the guide members 42K during the attachment and detachment of the first developing unit 11K to and from the drum unit 41K. The guide protrusion 63K is guided by the developing guide 45K of the remaining one of the guide members 42K during the attachment and detachment of the first developing unit 11K to and from the drum unit 41K.

4. Attachment and Detachment of Developing Unit to and from Housing

Next, attachment and detachment of the developing units 11K, 11Y, 11M, and 11C to and from the housing 2 will be described with reference to FIGS. 1, 2, 4, 6, and 7.

For attaching and detaching the developing units 11K, 11Y, 11M, and 11C to and from the housing 2, the cover 3 is moved from the closed position (FIGS. 1 and 4) to the open position (FIGS. 2 and 7).

By the movement of the cover 3 from the closed position to the interlocking position (FIG. 6), the LED arrays 5K, 5Y, 5M, and 5C are moved to the outside of the housing 2 as illustrated in FIGS. 4 and 6.

Then, as illustrated in FIGS. 6 and 7, the link members 21A and 21B are moved away from the axis A0 in the second direction in conjunction with the pivotal movement of the cover 3 from the interlocking position to the open position. In accordance with this movement of the link members 21A and 21B, the guide members 42K, 42Y, 42M, and 42C are pivotally moved. As a result, as illustrated in FIGS. 1 and 2, the developing units 11K, 11Y, 11M, and 11C are moved away from the axis A0 in the second direction.

Accordingly, the user can smoothly attach and detach the developing units 11K, 11Y, 11M, and 11C to and from the housing 2 from the one side of the housing 2 which is farther from the axis A0 in the second direction.

5. Function and Effect

In the image forming apparatus 1 according to the above-described embodiment, the developing units 11K, 11Y, 11M, and 11C can be moved away from the axis A0 in the second direction merely by moving the cover 3 to the open position as illustrated in FIGS. 1 and 2.

As a result, smooth attachment and detachment of the developing units 11K, 11Y, 11M, and 11C to and from the housing 2 can be performed from the one side of the housing 2 farther from the axis A0 in the second direction.

6. Modifications

While the description has been made in detail with reference to the above embodiment, it would be apparent to those skilled in the art that many modifications and variations may be made thereto.

In the above-described embodiment, each of the link members 21A and 21B is rectangular in shape as viewed in the first direction, and has the longest side extending in the second direction and the uniform length in the third direction perpendicular to the first and second directions. However, each of the link members 21A and 21B is not necessarily need to have the uniform length in the third direction. For example, each of the link members 21A and 21B may have a trapezoidal shape as viewed in the first direction whose longest side extends in the second direction. More specifically, the length of each of the link members 21A and 21B in the third direction may be gradually reduced in a direction from the spring 23 to the axis A0. Alternatively, the length in the third direction of each of the link members 21A and 21B may be gradually increased in the direction from the spring 23 to the axis A0.

Further, each of the link members 21A and 21B may have a triangular shape as viewed in the first direction whose longest side extends in the second direction. Here, the length in the third direction of each of the link members 21A and 21B may be gradually reduced in the direction from the spring 23 to the axis A0. Alternatively, the length of each of the link members 21A and 21B in the third direction may be gradually increased in the direction from the spring 23 to the axis A0. Incidentally, the above-described triangular shape includes an equilateral triangle shape, a right triangle shape, and an isosceles triangle shape.

In the above-described embodiment, each of the first bosses 24K, 24Y, 24M, and 24C has the solid cylindrical shape. However, each of the first bosses 24K, 24Y, 24M, and 24C may have an elliptic columnar shape, or may have a polygonal columnar shape. The same is true with respect to the second bosses 25K, 25Y, 25M, and 25C. That is, the engagement portions 26K, 26Y, 26M, and 26C may have any shape as long as the engagement portions 26K, 26Y, 26M, and 26C can be engaged with the protrusions 46K, 46Y, 46M, and 46C, respectively.

In the above-described embodiment, the first bosses 24K, 24Y, 24M, and 24C have shapes identical to one another. However, the shapes of the first bosses 24K, 24Y, 24M, and 24C may be different from each other. The same is true with respect to the second bosses 25K, 25Y, 25M, and 25C.

According to the above-described embodiment, the engagement portion 26K includes the first boss 24K and the second boss 25K. However, the engagement portion 26K may be a groove that guides the protrusion 46K. The same is true with respect to the engagement portions 26Y, 26M, and 26C.

According to the above-described embodiment, the protrusion 46K has the elliptic columnar shape. However, the protrusion 46K may be cylindrical, quadrangular prism or any other polygonal column. Preferably, the protrusion 46K be a column having a long side and a short side, since the protrusion 46K is positioned between the first boss 24K and the second boss 25K. For example, it is preferable that the protrusion 46K has a column shape having an elliptical cross-section, or rectangular cross-section. Anyway, any shape of the protrusion 46K is available as long as the protrusion 46K can be engaged with the engagement portion 26K. The same is true with respect to the protrusions 46Y, 46M, and 46C.

What is claimed is:

1. An image forming apparatus comprising:

a housing having an opening;

a cover pivotally movable about a door axis between an open position at which the cover opens the opening and a closed position at which the cover closes the opening, the door axis extending in a first direction;

a first process cartridge attachable to the housing and detachable from the housing through the opening in an open state where the cover is at the open position, the first process cartridge comprising:

a first photosensitive drum rotatable about a first drum axis extending in the first direction; and a first developing unit configured to supply first toner to the first photosensitive drum;

a second process cartridge attachable to the housing and detachable from the housing through the opening in the open state where the cover is at the open position, the second process cartridge comprising:

a second photosensitive drum rotatable about a second drum axis extending in the first direction; and a second developing unit configured to supply second toner to the second photosensitive drum;

a first LED array provided on the cover and configured to emit light to the first photosensitive drum;

a second LED array provided on the cover and configured to emit light to the second photosensitive drum;

a first roller rotatable about a first roller axis;

a second roller rotatable about a second roller axis; and a belt being looped over the first roller and the second roller, the belt being circularly movable around the first roller and the second roller, the belt having a contact surface in contact with the first photosensitive drum and the second photosensitive drum, wherein, in a state where the first process cartridge is attached to the housing and the second process cartridge is attached to the housing, the first drum axis of the first photosensitive drum is positioned below the second drum axis of the second photosensitive drum, and wherein the second roller axis of the second roller is positioned below the first roller axis of the first roller.

2. The image forming apparatus according to claim 1, wherein the first process cartridge further comprises a first drum unit rotatably supporting the first photosensitive drum, and wherein the first developing unit is attachable to the first drum unit and detachable from the first drum unit.

3. The image forming apparatus according to claim 2, wherein the first process cartridge further comprises a first guide member configured to guide the attachment of the first developing unit to the first drum unit and the detachment of the first developing unit from the first drum unit.

4. The image forming apparatus according to claim 3, further comprising a link member coupling the cover and the first developing unit in an attached state where the first process cartridge is attached to the housing, the link member being movable in a second direction perpendicular to the first direction in interlocking relation to movement of the cover, the link member being configured to:

move the first developing unit away from the first drum axis in the second direction during movement of the cover from the closed position to the open position; and move the first developing unit toward the first drum axis in the second direction during movement of the cover from the open position to the closed position, wherein the link member is configured to move the first guide member of the first process cartridge to move the first developing unit.

5. The image forming apparatus according to claim 4, wherein the first guide member of the first process cartridge is configured to guide the first developing unit in a direction away from the door axis during the detachment of the first developing unit from the first drum unit in the open state of the cover.

6. The image forming apparatus according to claim 5, wherein the first guide member of the first process cartridge comprises a first part and a second part positioned opposite to the first photosensitive drum with respect to the first part, the first part of the first guide member extending in a vertical direction in the open state of the cover, the second part of the first guide member extending from an upper end portion of the first part in the direction away from the door axis in the open state of the cover.

7. The image forming apparatus according to claim 5, wherein the link member comprises:

a first link member; and a second link member positioned away from the first link member in the first direction, the first link member being connected to the cover and the first developing unit in the attached state of the first process cartridge, the first link member being movable in the second direction in interlocking relation to the movement of the cover, the first link member being configured to:

in cooperation with the second link member, move the first developing unit away from the door axis in the second direction during the movement of the cover from the closed position to the open position; and in cooperation with the second link member, move the first developing unit toward the door axis in the second direction during the movement of the cover from the open position to the closed position, the second link member being coupled to the cover and the first developing unit in the attached state of the first process cartridge, the second link member being movable in the second direction in interlocking relation to the movement of the cover, and the second link member being configured to:

in cooperation with the first link member, move the first developing unit away from the door axis in the second direction during the movement of the cover from the closed position to the open position; and in cooperation with the first link member, move the first developing unit toward the door axis in the second direction during the movement of the cover from the open position to the closed position, and wherein the first guide member of the first process cartridge comprises:

a first guide portion configured to guide the attachment of the first developing unit to the first drum unit and the detachment of the first developing unit from the first drum unit; and a second guide portion positioned away from the first guide portion in the first direction, the second guide portion being configured to guide the attachment of the first developing unit to the first drum unit and the detachment of the first developing unit from the first drum unit.

8. The image forming apparatus according to claim 1, wherein, in a state where the cover is at the closed position, the cover is sloped downward away from the door axis in a second direction perpendicular to the first direction.

9. The image forming apparatus according to claim 1, further comprising:

a first drum cleaner configured to remove toner from a peripheral surface of the first photosensitive drum;

a second drum cleaner configured to remove toner from a peripheral surface of the second photosensitive drum;

a belt cleaner configured to remove toner from a peripheral surface of the belt;

a waste toner cartridge configured to accommodate therein toner removed by the first drum cleaner, the second drum cleaner, and the belt cleaner; and a conveyer tube for conveying toner removed by the first drum cleaner, the second drum cleaner, and the belt cleaner to the waste toner cartridge, the conveyer tube being inclined downward away from the door axis in a second direction perpendicular to the first direction.

10. The image forming apparatus according to claim 1, further comprising:

a third roller rotatable about a third roller axis, the third roller axis of the third roller being positioned below the first roller axis of the first roller, wherein the belt is looped over the first roller, the second roller and the third roller, and the belt is circularly movable around the first roller, the second roller and the third roller.

11. The image forming apparatus according to claim 1, further comprising:

a belt onto which a toner image is transferred from the first photosensitive drum of the first process cartridge and the second photosensitive drum of the second process cartridge, the belt being in contact with the first photosensitive drum of the first process cartridge and the second photosensitive drum of the second process cartridge; and a transfer roller in contact with the belt, the transfer roller being configured to transfer the toner image from the belt to a sheet.

12. The image forming apparatus according to claim 1, wherein, in the state where the first process cartridge and the second process cartridge are attached to the housing:

the first process cartridge and the second process cartridge are arrayed in a second direction perpendicular to the first direction, and a distance in the second direction between the first drum axis and the door axis is greater than a distance in the second direction between the second drum axis and the door axis.

13. An image forming apparatus comprising:

a housing having an opening;

a cover pivotally movable about a door axis between an open position at which the cover opens the opening and a closed position at which the cover closes the opening, the door axis extending in a first direction;

a first process cartridge attachable to the housing and detachable from the housing through the opening in an open state where the cover is at the open position, the first process cartridge comprising:

a first photosensitive drum rotatable about a first drum axis extending in the first direction;

a first developing unit configured to supply first toner to the first photosensitive drum;

a first drum unit rotatably supporting the first photosensitive drum, wherein the first developing unit is attachable to the first drum unit and detachable from the first drum unit; and a first guide member configured to guide the attachment of the first developing unit to the first drum unit and the detachment of the first developing unit from the first drum unit;

a second process cartridge attachable to the housing and detachable from the housing through the opening in the open state where the cover is at the open position, the second process cartridge comprising:

a second photosensitive drum rotatable about a second drum axis extending in the first direction;

a second developing unit configured to supply second toner to the second photosensitive drum;

a first LED array provided on the cover and configured to emit light to the first photosensitive drum;

a second LED array provided on the cover and configured to emit light to the second photosensitive drum; and a link member coupling the cover and the first developing unit in an attached state where the first process cartridge is attached to the housing, the link member being movable in a second direction perpendicular to the first direction in interlocking relation to movement of the cover, wherein the link member is configured to:

move the first developing unit away from the first drum axis in the second direction during movement of the cover from the closed position to the open position; and move the first developing unit toward the first drum axis in the second direction during movement of the cover from the open position to the closed position, wherein the link member is configured to move the first guide member of the first process cartridge to move the first developing unit, and wherein, in a state where the first process cartridge is attached to the housing and the second process cartridge is attached to the housing, the first drum axis of the first photosensitive drum is positioned below the second drum axis of the second photosensitive drum.

14. The image forming apparatus according to claim 13, wherein the first guide member of the first process cartridge is configured to guide the first developing unit in a direction away from the door axis during the detachment of the first developing unit from the first drum unit in the open state of the cover.

15. The image forming apparatus according to claim 14, wherein the first guide member of the first process cartridge comprises a first part and a second part positioned opposite to the first photosensitive drum with respect to the first part, the first part of the first guide member extending in a vertical direction in the open state of the cover, the second part of the first guide member extending from an upper end portion of the first part in the direction away from the door axis in the open state of the cover.

16. The image forming apparatus according to claim 14, wherein the link member comprises:

a first link member; and a second link member positioned away from the first link member in the first direction, the first link member being connected to the cover and the first developing unit in the attached state of the first process cartridge, the first link member being movable in the second direction in interlocking relation to the movement of the cover, the first link member being configured to:

in cooperation with the second link member, move the first developing unit away from the door axis in the second direction during the movement of the cover from the closed position to the open position; and in cooperation with the second link member, move the first developing unit toward the door axis in the second direction during the movement of the cover from the open position to the closed position, the second link member being coupled to the cover and the first developing unit in the attached state of the first process cartridge, the second link member being movable in the second direction in interlocking relation to the movement of the cover, and the second link member being configured to:

in cooperation with the first link member, move the first developing unit away from the door axis in the second direction during the movement of the cover from the closed position to the open position; and in cooperation with the first link member, move the first developing unit toward the door axis in the second direction during the movement of the cover from the open position to the closed position, and wherein the first guide member of the first process cartridge comprises:

a first guide portion configured to guide the attachment of the first developing unit to the first drum unit and the detachment of the first developing unit from the first drum unit; and a second guide portion positioned away from the first guide portion in the first direction, the second guide portion being configured to guide the attachment of the first developing unit to the first drum unit and the detachment of the first developing unit from the first drum unit.

17. The image forming apparatus according to claim 3, wherein the second process cartridge further comprises a second drum unit rotatably supporting the second photosensitive drum, and wherein the second developing unit is attachable to the second drum unit and detachable from the second drum unit.

18. The image forming apparatus according to claim 17, wherein the second process cartridge further comprises a second guide member configured to guide the attachment of the second developing unit to the second drum unit and the detachment of the second developing unit from the second drum unit.

19. The image forming apparatus according to claim 13, wherein, in the state where the first process cartridge and the second process cartridge are attached to the housing:

the first process cartridge and the second process cartridge are arrayed in the second direction, and a distance in the second direction between the first drum axis and the door axis is greater than a distance in the second direction between the second drum axis and the door axis.

* * * * *